United States Patent [19]

Newbegin

[11] 4,020,768

[45] May 3, 1977

[54] TOW LINE ACCUMULATOR

[75] Inventor: John Newbegin, Easton, Pa.

[73] Assignee: SI Handling Systems, Inc., Easton, Pa.

[22] Filed: July 21, 1975

[21] Appl. No.: 597,935

[52] U.S. Cl. ..... 104/172 BT

[51] Int. Cl.[2] ..... B65G 17/42

[58] Field of Search ..... 104/172 R, 172 B, 172 BT, 104/170, 178

[56] References Cited

UNITED STATES PATENTS

| | | | |
|---|---|---|---|
| 3,418,945 | 12/1968 | Stevenson et al. | 104/172 BT |
| 3,520,255 | 7/1970 | Hefler | 104/172 BT |
| 3,606,840 | 9/1971 | Karlstrom | 104/172 BT |
| 3,648,618 | 3/1972 | Pierson et al. | 104/172 BT X |
| 3,669,027 | 6/1972 | Haase et al. | 104/172 BT |

*Primary Examiner*—Robert J. Spar
*Assistant Examiner*—Randolph A. Reese
*Attorney, Agent, or Firm*—Seidel, Gonda & Goldhammer

[57] ABSTRACT

A tow line accumulator is provided having at least one conveyor chain track or channel which is stationary and associated with first and second movable control members. The control members cause a tow pin on a driverless tow vehicle to lose contact with a pusher dog on the conveyor chain whereby the vehicle will come to a stop at the accumulator.

4 Claims, 4 Drawing Figures

FIG. 3
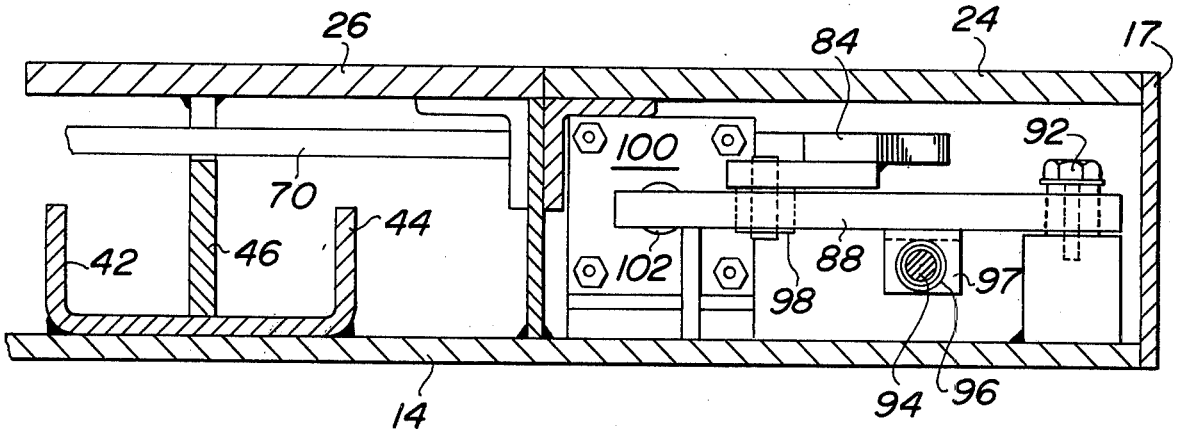
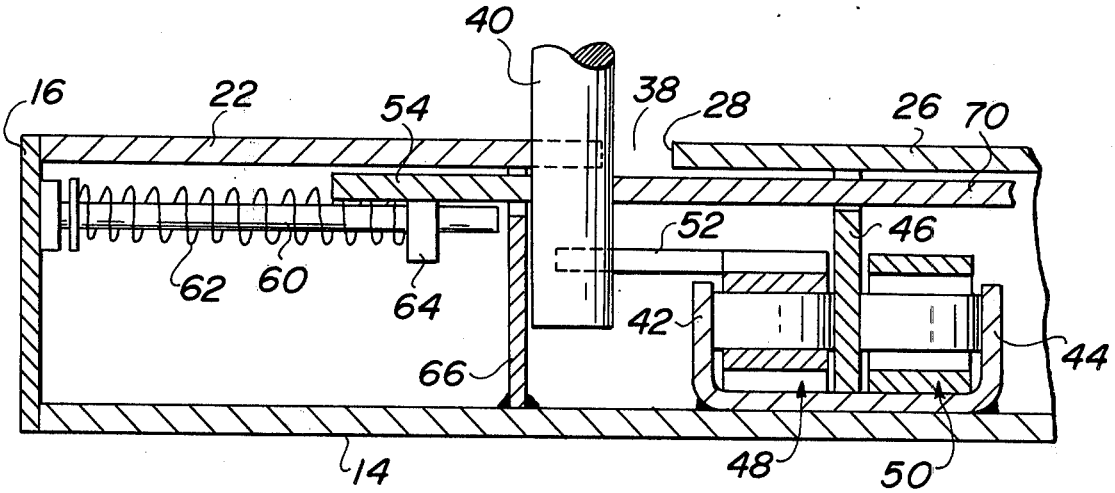
FIG. 4

TOW LINE ACCUMULATOR

BACKGROUND

An accumulator of the type involved herein is classified in Class 104, subclass 172. U.S. Pat. Nos. 3,520,255; 3,606,840 and 3,669,027 are exemplary of the prior art. In prior art accumulators of the type involved herein, a portion of the conveyor chain track was movable. Every time a conveyor chain guide roller past over the joint of a movable track, it created noise. The accumulator of the present invention is structurally interrelated in a manner so as to minimize the noise involved during operation, minimizing the number of parts that move, and has other advantages as will be set forth hereinafter.

DISCLOSURE

This invention relates to a tow line accumulator for stopping driverless tow line vehicles having a tow pin pushed along a guide track or slot by a conveyor dog. The accumulator includes a housing having at least one stationary track for the conveyor chain. First and second control members are provided with each having a surface for contacting a tow pin and shifting a tow pin transversely of said track.

The accumulator of the present invention includes a first means for biasing the first control member toward the second control member as well as a second means biasing said second member toward said first control member. The first biasing means is superior in strength as compared with the second biasing means. Also, there is provided a latch means for selectively retaining the second control member in a latched position whereby said first biasing means is unable to overcome the biasing effect of said second biasing means.

It is an object of the present invention to provide a tow line accumulator wherein any tracks forming a part thereof are stationary so as to be free from any joints and hence quieter in operation.

It is another object of the present invention to provide a tow line accumulator having only three movable parts and thereby being simpler in design as compared with prior accumulators.

It is another object of the present invention to provide a tow line accumulator for driverless tow vehicles which is constructed in a manner so as to minimize manufacturing costs while prolonging its service life with minimum maintenance.

Other objects will appear hereinafter.

For the purpose of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 1.

FIG. 4 is a sectional view taken along the line 4—4 in FIG. 1.

Referring to the drawing in detail wherein like numerals indicate like elements there is shown an accumulator in accordance with the present invention designated generally as 10.

Figure 1:
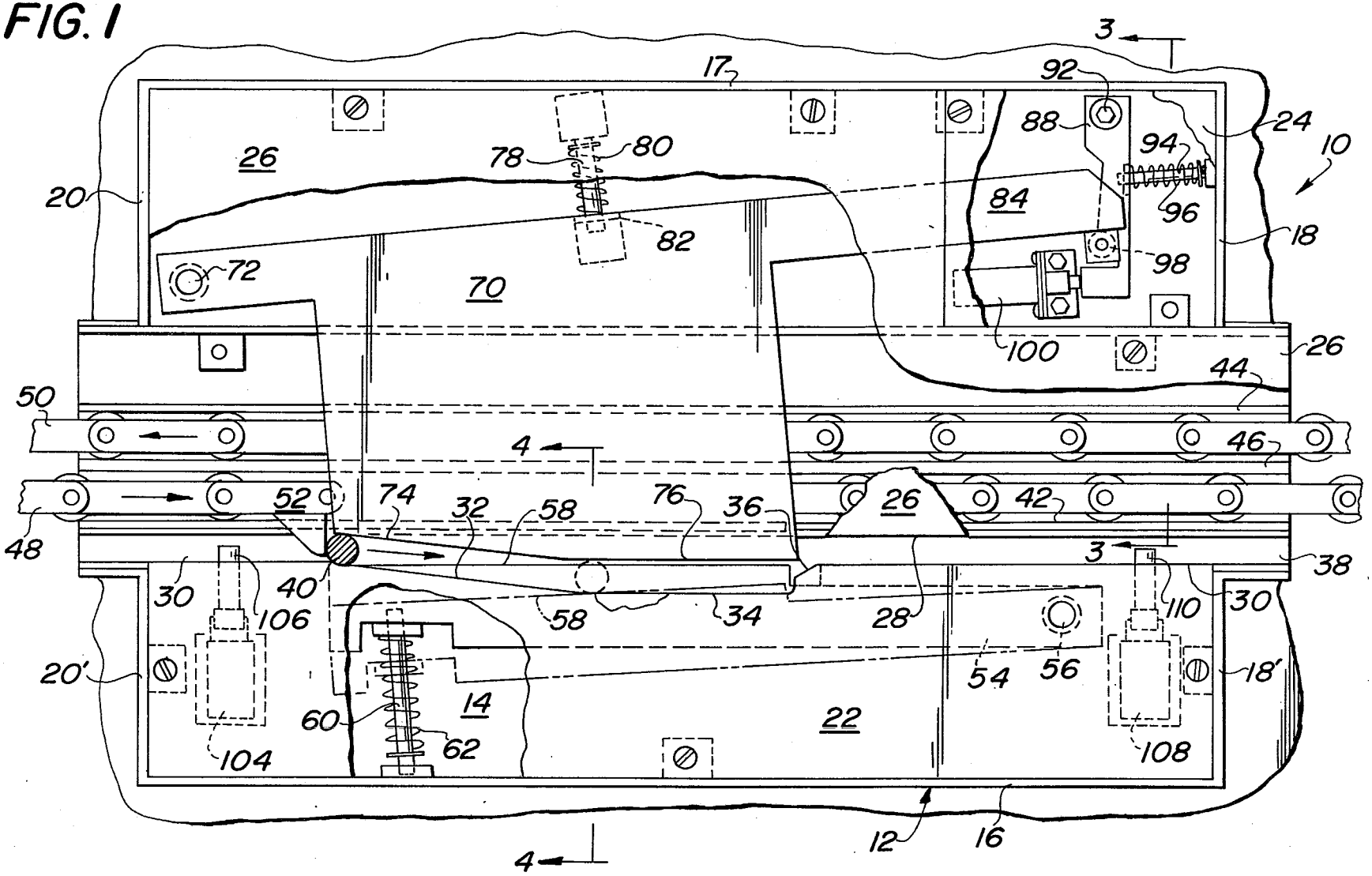
FIG. 1 is a top plan view of an accumulator in accordance with the present invention with the components arranged to cause a tow vehicle to halt at the accumulator.

The accumulator 10 includes a prefabricated housing adapted to be mounted in a floor or the like with its uppermost surface flush with the floor. The housing designated generally as 12 includes a horizontally disposed bottom wall 14; upstanding side walls 16, 17; spaced end wall 18, 18' at one end and spaced end walls 20, 20' at the other end. The housing 12 is provided with three discrete removable top walls designated 22, 24 and 26. Top wall 24 is rectangular and is located in the upper righthand corner of the housing 12 as illustrated in FIG. 1. Top wall 26 is larger than top walls 22, 24.

The top wall 26 has a side edge 28 which is straight and extends for the entire length of the accumulator 10. Each of the top walls 22–26 are removable secured to a side or end wall of the housing 12 and are stationary during operation of the accumulator 10.

The top wall 22 has a side edge defined by the numerals 30, 32, 34 and 36 juxtaposed to the side edge 28 thereby defining a tow pin slot 38 extending the full length of the accumulator 10. The portion of the edge of top wall 22 defined by the numerals 30 and 34 are straight and parallel to edge 28. Edge 32 is angled away from edge 28 and interconnects edges 30 and 34. Edge 36 is angled between edges 30 and 34 toward the edge 28 as shown more clearly in FIG. 1.

The vertically disposed tow pin 40 of a driverless tow vehicle, not shown, is illustrated disposed within the tow pin slot 38. As shown more clearly in FIG. 4, there is provided tracks 42 and 44 having a center partition 46 disposed within the housing 12 and to one side of the tow pin slot 38. A run of a conveyor chain 48 is guided by track 42 and partition 46. A return run of the conveyor chain is designated 50 and is guided by the track 44 and partition 46. It is not necessary that the return run of the conveyor chain pass through the accumulator 10. In that event, only one track would be needed. It will be noted that the runs of the conveyor chain include rollers at spaced points therealong and which rotate about vertical axes. The tow pin 40 and the vehicle to which it is attached are moved along the guide slot to be aligned with slot 38 as a result of contact with a dog 52 projecting to one side of the conveyor chain. At no time is the tow pin 40 directly above the conveyor chain.

A first control member designated 54, in the form of a horizontally disposed plate, is provided for pivotable movement about the vertically disposed pin 56 located at the downstream end of housing 12. Member 54 has a side edge 58 which forms a continuation of the edges 30 parallel to the edge 28 in one position of control member 54. Control member 54 is biased to that one position by a spring 62 surrounding a guide rod 60. Guide rod 60 extends from a bracket on the side wall 16 and through a downwardly depending projection 64 of the lower surface of control member 54. See FIG. 4. The projection 64 has an enlarged hole for accommodating the pin 60.

Beneath the top wall 22, a housing is provided with a longitudinally extending partition 66 generally parallel to the track 42 but having a height for most of its length which is less than the height of the side wall 16. The partition 66 is provided with a cutout slot adjacent its upper edge to facilitate movement of the control member 54 therethrough while the remainder of the upper edge of partition 66 supports the juxtaposed bottom surface of top wall 22. The down stream end of the slot in the upper edge of partition 66 is provided with a limit stop 68 directly beneath the edge 36. Compare FIGS. 1 and 2.

A second control member 70, generally in the form of a horizontally disposed plate, is provided at the same elevation as control member 54 but on the opposite side of the two pin slot 38. Control member 70 is mounted for pivotable movement about the vertically disposed pin 72 at the upstream end of housing 12. It will be noted that the pins 56 and 72 are at opposite ends of the housing 12. If desired, control member 70 could be mounted for pivotable movement about a pin located at the downstream end of housing 12. Immediately adjacent the tow pin slot 38, the control member 70 has an up stream angularly disposed edge 74 parallel to edge 32 and an adjacent down stream straight edge 76 parallel to edge 34.

The control member 70 is biased in the position shown in FIG. 1 by a spring 80 surrounding guide pin 78. Guide pin 78 extends through an enlarged hole in a downwardly extending projection 82 on the lower surface of control member 70. Spring 80 is weaker than spring 62.

The control member 70 has a generally longitudinally extending extension 84 which is generally opposite the location of pin 56. The extension 84 cooperates with a releasable latch designated generally as 86. The latch 86 includes a latch lever 88 having a notch 90 adjacent one end and is mounted for pivotable movement adjacent its other end by a vertically disposed pin 92. A guide pin 94 extends through an enlarged hole in a downwardly extending projection 97 on the lower surface of the lever 88. A spring 96 surrounds pin 94 and biases the lever 88 to the position shown in FIG. 1.

The projection 84 of control member 70 terminates in a vertically disposed follower 98 which is adapted to be received within the notch 90. A solenoid 100 is provided with a plunger 102 in a location whereby it may act upon lever 88 and pivot the same from the position shown in FIG. 1 to the position shown in FIG. 2 thereby compressing the spring 96. Access to the solenoid 100 and the latch 86 is attained by removing the top wall 24.

Figure 2:
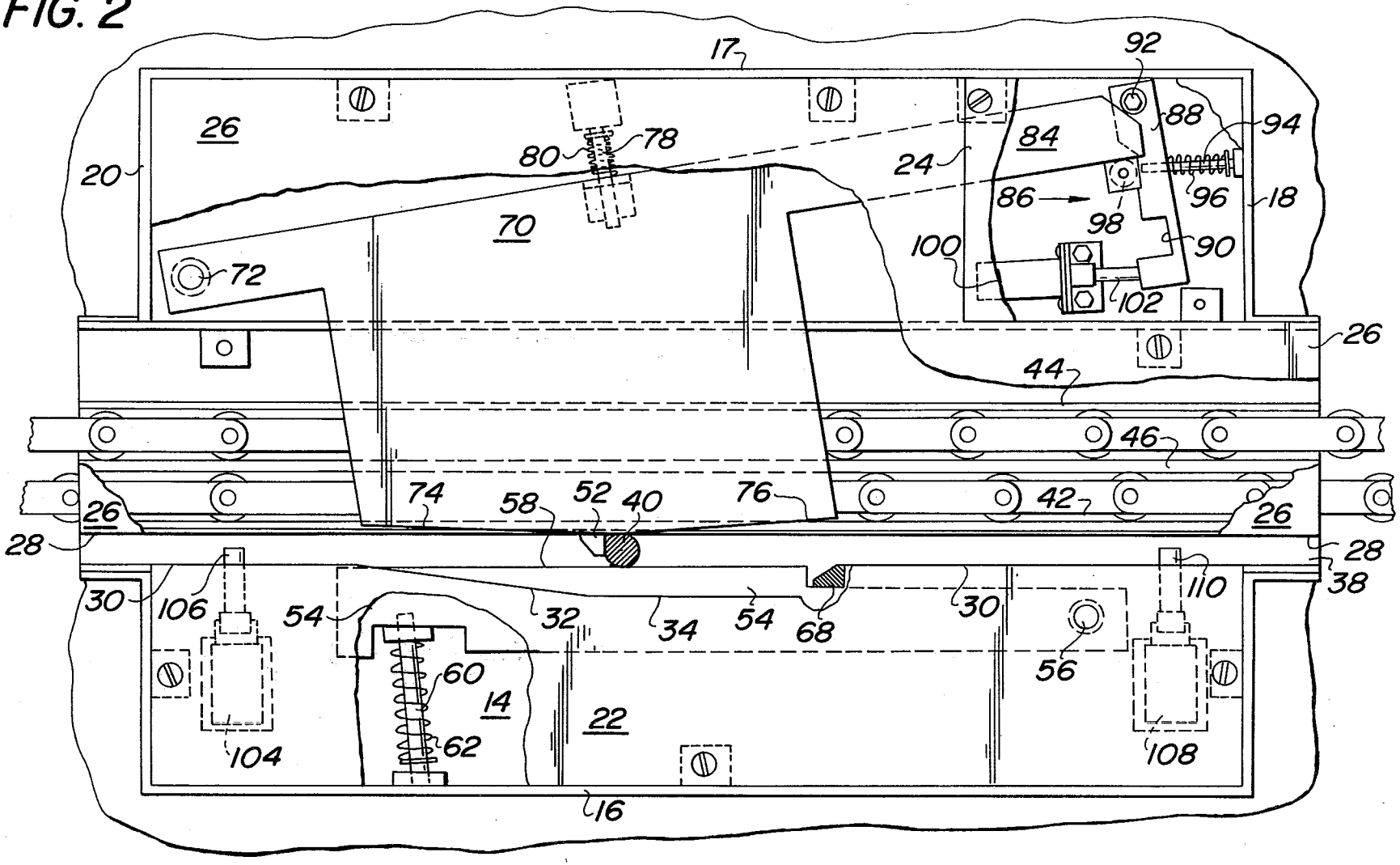
FIG. 2 is a view similar to FIG. 1 but with the components arranged in the position they occupy when a tow vehicle will pass through the accumulator without stopping.

At the up stream end of the accumulator 10, that is the lefthand end of FIGS. 1 and 2, there is provided a switch 104 having an actuator 106. At the downstream end of the accumulator 10, there is provided a switch 108 having an actuator 110. When actuator 110 is tripped by the tow pin 40 as it exits from the accumulator 10, switch 108 deactivates the solenoid 100. If it is desired to permit a vehicle to pass through the accumulator without stopping, switch 104 is coupled by manipulation of a switch not shown to the solenoid 100 so that contact between the incoming tow pin 40 and the actuator 106 will activate solenoid 100 whereby the components of the accumulator 10 will be in a position as shown in FIG. 2. As a result thereof, the tow pin 40 will pass entirely through the slot 38 without stopping.

The operation of the accumulator 10 is as follows:

Initially, let it be assumed that it is desired to cause a vehicle to stop at the location of the accumulator 10. The purpose for causing the vehicle to stop may vary and include loading, unloading, performing a work function on the structure supported by the vehicle, etc. The components of the accumulator 10 will be the position as shown in FIG. 1.

As the vehicle is moved under the influence of the dog 52 pushing against the vertically disposed tow pin 40, the tow pin 40 enters the lefthand end of the slot 38 until it contacts the edge 74 of control member 70. Due to the fact that edge 74 of control member 70 and edge 58 of control member 54 being arranged to define a converging angle which is smaller than the diameter of the tow pin 40, the tow pin 40 is caused to shift downwardly in FIG. 1 in view of the following. Edge 74 has a camming effect on the tow pin 40. Due to the latch 86, the control member 70 is stationary. However, the control member 54 may pivot counterclockwise in FIG. 1. Thus, the force imparted to the tow pin 40 by edge 74 shifts the tow pin against the edge 58 of the control member 54 thereby pivoting the control member against the spring 62 so that the tow pin may move through the parallel path defined by edges 74 and 32.

As the tow pin 40 moves along the path defined by the edges 74 and 32, it gradually loses contact with the pusher dog 52. When the tow pin 40 is in the path defined by parallel edges 76 and 34, it has totally lost contact with the pusher dog 52. The location where the tow pin 40 will stop depends upon the momentum it had, the load it is carrying, etc. When the load is very heavy, the tow pin may reach as far as the limit stop 68 before coming to a complete halt.

As the tow pin is coming to a halt, it is causing the control member 54 to compress the springs 62. Due to the mechanical advantage of the lever-like control member 54, there is a pinch on the tow pin 40 by the control member 54 which helps to apply a drag to cause the vehicle to stop. In the stopping of a typical vehicle, control member 54 will depress the spring 62 for a distance about one inch to two inches.

When it is desired to cause the vehicle to become reengaged with a pusher dog on the conveyor run 48, it is only necessary to electrically activate solenoid 100. When solenoid 100 is activated, plunger 102 pivots the lever 88 from the position shown in FIG. 1 to the position shown in FIG. 2 thereby compressing spring 96. The force transmitted to the control member 70 at its edge 76 by the tow pin 40 due to expansion of spring 62 pivots the control member 70 from the position shown in FIG. 1 to the position shown in FIG. 2. The pivotable movement of control member 70 facilitates shifting of tow pin 40 sideways from the phantom position shown in FIG. 1 to a position wherein it is again disposed within the slot 38 as shown in solid lines in FIG. 2.

The next dog on the conveyor run 48 will contact the tow pin 40 and propel the vehicle through the remainder of the slot 38 and along a guide slot in the floor or the like which is aligned with slot 38. As the vehicle is exiting from the accumulator 10, the tow pin 40 triggers the actuator 110 of switch 108 to thereby deactivate the solenoid 100. When the solenoid 100 is deactivated, the components of the latch 86 will move from the position shown in FIG. 2 to the position shown in FIG. 1. Control member 70 will previously have been pivoted from the position shown in FIG. 2 to the position shown in FIG. 1 by expansion of spring 80.

It will be noted that the springs 62 and 80 oppose one another. However, spring 62 is substantially stronger than spring 80 but is unable to overcome the force of spring 80 until after latch 86 has released the follower 98.

As soon as the solenoid 100 has been deactivated, the accumulator 10 is ready to receive another vehicle. If it is desired to have a vehicle pass entirely through the accumulator without stopping, switch 104 will be coupled to activate the solenoid 100 by manipulation of a switch at a remote point. Under normal conditions, switch 104 is incapable of effecting the operation of solenoid 100. When the tow pin 40 contacts the actuator 106, the switch 104 closes and thereby activates solenoid 100. Activation of solenoid 100 releases the latch 86. Hence, the tow pin 40 merely cams the control member 70 from the position shown in FIG. 1 to the position shown in FIG. 2 by contact with the edges 74 and 76. Spring 78 is compressed by such movement.

After the tow pin 40 has lost contact with the control member 70, spring 80 expands to thereby position the follower 98 opposite the notch 90. Immediately thereafter, the tow pin 40 triggers the actuator 110 so that switch 108 is activated to thereby deactivate the solenoid 100 to cause withdrawal of the plunger 102 and expansion of the spring 96. Hence, the control member 70 is again latched in the position as shown in FIG. 1.

When a vehicle is stopped at the accumulator 10, and another vehicle is immediately behind it, the second vehicle will likewise be caused to accumulate. Such accumulation of the second vehicle will be accomplished by contact between a rear edge of the first vehicle and a movable bumper or the like on the second vehicle which in turn will cause the tow pin on the second vehicle to be raised vertically out of contact with the pusher dog on the conveyor run 48. Thus, it will be seen that one or more vehicles may be caused to stop at the accumulator 10 or in the alternative there is the option of permitting one or more vehicles to pass through the accumulator 10 without stopping. Due to the fact that there are no joints in the sections of the track, accumulator 10 is quieter than previously proposed constructions. The simplicity of three moving parts (control members 54, 70 and latch 86) minimizes manufacturing costs and minimizing maintenance problems.

Access to the latch 86 is attained by removing the top wall 24. Access to the control member 70 and spring 80 is attained by removal of the top wall 26. Access to the control member 54 as well as the switches 104, 108 is attained by removal of the top wall 22. A device such as an air cylinder could be substituted for each of the above-mentioned springs and/or the solenoid 100.

The present invention may be embodied in other specific forms without departing from the spirit or essential attributes thereof and, accordingly, reference should be made to the appended claims, rather than to the foregoing specification as indicating the scope of the invention.

I claim:

1. An accumulator for stopping vehicles having a tow pin which is pushed by a conveyor dog comprising:

a. a housing adapted for installation in a floor, said housing having at least one stationary track therewithin and open at both ends, b. means defining a top wall for said housing, said top wall having a tow pin slot through which a tow pin may extend for contact with a pusher dog on a conveyor run in said track, said slot having an edge angled with respect to said track and wherein a tow pin is no longer in contact with a pusher dog, c. first and second control members movably mounted in said housing, each control member having spaced edges for shifting a tow pin which is out of contact with the pusher dog transversely with respect to said track, said spaced edges being at substantially the same elevation below the elevation of said slot for contact with a tow pin extending through the slot, said second member having an angled edge generally parallel to said angled edge of said slot, said second member having a stationary accumulation position wherein said angled edges are arranged for stationary cooperation in shifting a moving tow pin, d. first means for biasing said first member toward said second member, second means for biasing said second member toward said first member to said accumulation position at all times, and e. latch means operatively associated with said second member for selectively retaining said second member in its stationary accumulation position.

2. An accumulator in accordance with claim 1 wherein said housing has an upstream end and a downstream end, said first control member being mounted for pivotable movement about a vertical axis adjacent one of said housing ends and said second control member being mounted for pivotable movement about a vertical axis adjacent an opposite end of said housing.

3. An accumulator in accordance with claim 2 wherein said latch means includes a pivotably mounted lever and a solenoid actuator for said lever.

4. An accumulator in accordance with claim 3 including a switch in said housing adjacent the downstream end thereof, said switch being adapted to deactivate said solenoid, said switch having an actuator projecting into a zone below the elevation of said slot for contact with a tow pin moving through said zone.

* * * * *